US010180296B2

(12) United States Patent
Polston

(10) Patent No.: US 10,180,296 B2
(45) Date of Patent: Jan. 15, 2019

(54) FIREARM ADAPTED TO USE LINKED AMMUNITION AND KIT FOR CONVERTING MAGAZINE-FED FIREARM TO SAME

(71) Applicant: Timothy J. Polston, Jacksonville, AR (US)

(72) Inventor: Timothy J. Polston, Jacksonville, AR (US)

( * ) Notice: Subject to any disclaimer, the term of this patent is extended or adjusted under 35 U.S.C. 154(b) by 0 days.

(21) Appl. No.: 15/638,634

(22) Filed: Jun. 30, 2017

(65) Prior Publication Data

US 2018/0003452 A1 Jan. 4, 2018

Related U.S. Application Data

(60) Provisional application No. 62/357,676, filed on Jul. 1, 2016.

(51) Int. Cl.

| | |
|---|---|
| ***F41A 9/29*** | (2006.01) |
| ***F41A 3/66*** | (2006.01) |
| ***F41C 7/00*** | (2006.01) |
| *F41A 5/18* | (2006.01) |

(52) U.S. Cl.
CPC *F41A 9/29* (2013.01); *F41A 3/66* (2013.01); *F41C 7/00* (2013.01); *F41A 5/18* (2013.01)

(58) Field of Classification Search
CPC ..... F41A 9/29; F41A 9/30; F41A 9/32; F41A 9/34
See application file for complete search history.

(56) References Cited

U.S. PATENT DOCUMENTS

| | | | | |
|---|---|---|---|---|
| 3,802,313 A * | 4/1974 | Rocha | F41A 3/82 | 89/130 |
| 3,960,053 A * | 6/1976 | Conley | F41A 3/70 | 89/149 |
| 4,492,145 A * | 1/1985 | Curtis | F41A 21/484 | 89/33.2 |
| 6,634,274 B1 | 10/2003 | Herring | | |
| 7,568,421 B2 | 8/2009 | Cummings | | |

(Continued)

FOREIGN PATENT DOCUMENTS

DE 4334412 * 8/1995

OTHER PUBLICATIONS

Blog post at http://www.gunco.net/forums/50-your-completed-ak-projects/34001-belt-feed-ak-47-a-2.html (2007).

(Continued)

*Primary Examiner* — Stephen Johnson

(57) ABSTRACT

A firearm is adapted to use linked ammunition, either as a stand-alone firearm or a kit for the firearm. A belt feed lever is actuated by a drive roller in communication with the firearm recoil assembly. The belt feed lever turns a vertical drive shaft. The drive shaft operates a lower pawl, the manipulation of which advances the next round of linked ammunition to a position above the feed ramp. The firearm feeds linked ammunition "upside down," that is, with the links facing downward. A box mount is fitted in place of the standard box magazine when the firearm is used to fire linked ammunition, thereby providing a feed tray and feed follower. To convert back to the use of ammunition fed from magazines, the user need only remove the box mount and replace it with a traditional box magazine.

8 Claims, 3 Drawing Sheets

(56) References Cited

U.S. PATENT DOCUMENTS

| | | | |
|---|---|---|---|
| 8,136,440 | B1 | 3/2012 | Shirts et al. |
| 8,869,672 | B2 | 10/2014 | Smith |
| 9,488,425 | B2 | 11/2016 | Delury et al. |

OTHER PUBLICATIONS

Blog post at http://www.thefirearmblog.com/blog/2010/10/25/valkyrie-armament-belt-fed-ar-15-rifle-conversion (2010).

* cited by examiner

FIREARM ADAPTED TO USE LINKED AMMUNITION AND KIT FOR CONVERTING MAGAZINE-FED FIREARM TO SAME

CROSS-REFERENCE TO RELATED APPLICATIONS

This application claims the benefit of U.S. provisional patent application No. 62/357,676, entitled "Firearms Accessories," filed on Jul. 1, 2016. Such application is incorporated herein by reference in its entirety.

STATEMENT REGARDING FEDERALLY SPONSORED RESEARCH OR DEVELOPMENT

Not applicable.

BACKGROUND OF THE INVENTION

Semiautomatic firearms have become very popular in the United States. The AR-15 semiautomatic rifle, which is similar in appearance to the selective-fire M-16 rifle and M-4 carbine used by the US military, is currently the best-selling rifle model in the United States. Another popular semiautomatic rifle model is the semi-automatic version of the Soviet-designed AK-47 rifle. A great number of different companies make versions of these rifles in various configurations.

One of the reasons these rifles have proven so popular is that there are a great many after-market parts that allow such rifles to be customized in various ways to fit the owner's particular interests. One desirable feature that remains unavailable, however, is a simple, reliable means by which such firearms may be adapted to fire linked ammunition. These particular firearms and many others like them fire ammunition that is fed from a detachable box magazine. Use of linked ammunition would allow the user to fire a greater number of rounds of ammunition without the necessity of stopping to reload the weapon by changing magazines (and, if not performed previously, filling the magazine with ammunition). Although the prior art includes a number of attempts to adapt such firearms to fire linked ammunition, none of these solutions have proven satisfactory.

References mentioned in this background section are not admitted to be prior art with respect to the present invention.

BRIEF SUMMARY OF THE INVENTION

The present invention is directed to a firearm that is adapted to use linked ammunition and a kit for converting a magazine-fed firearm to use linked ammunition. In various non-limiting embodiments, the modifications and additional parts necessary in order to enable the use of linked ammunition may be integral to the firearm itself; may be attached permanently to the firearm such as by welding; or may be removably detachable from the firearm. In particular embodiments, the firearm allows for the use of box magazines in addition to the use of linked ammunition, at the option of the user. This is achieved by the use of a belt feed lever activated by a drive roller in communication with the recoil assembly of the firearm, the belt feed lever turning a feed arm drive shaft that is linked to a feed mechanism that is linked to pawls that reliably feed the linked ammunition. A box mount is fitted in place of the ammunition magazine when the firearm is used to fire linked ammunition, the box mount including a feed tray and feed follower that also serves to reliably feed ammunition when linked ammunition is used. To convert back to the use of ammunition fed from magazines in such embodiment, the user need only remove the box mount and replace it with a traditional box magazine filled with ammunition.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENT(S)

Before the present invention is described in further detail, it should be understood that the invention is not limited to the particular embodiments described, and that the terms used in describing the particular embodiments are for the purpose of describing those particular embodiments only, and are not intended to be limiting, since the scope of the present invention will be limited only by the claims.

Figure 1:
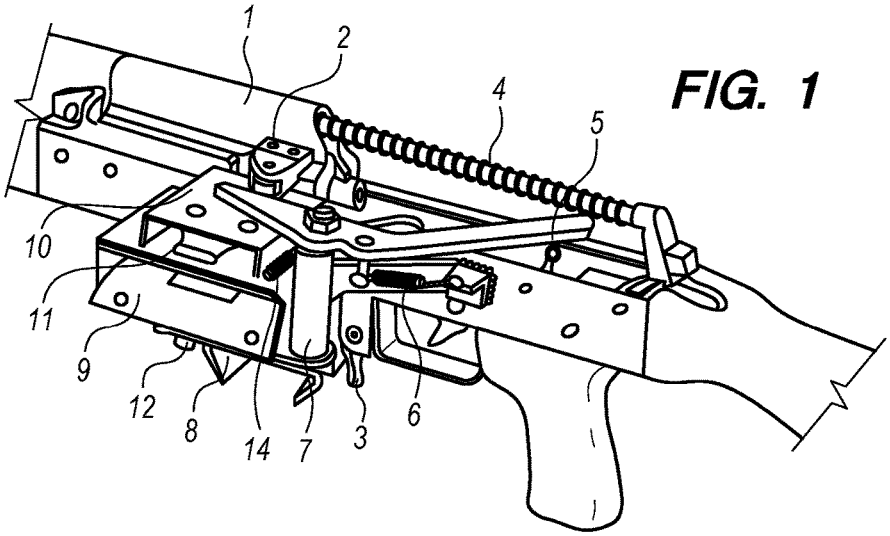
FIG. 1 is a perspective, partial cut-away view of an embodiment of the invention (the stock and barrel of the firearm are not shown).

With reference now to FIG. 1, a particular embodiment of the invention may be described. It should be noted that the invention is illustrated as used in conjunction with a semi-automatic AK-47 rifle. The invention is not so limited, however, and can be adapted in alternative embodiments for use with respect to any semiautomatic, selective fire, or automatic firearm that is configured for the use of detachable box magazines. Also, although the particular embodiment shows certain of the components of the invention welded or otherwise permanently attached to the AK-47 receiver, the invention is not so limited, and also includes a receiver that is integral with these components, as well as various means of making the components removably detachable from the receiver, such as by the use of bolt-on components.

Before describing the operation of the linked ammunition feed components of the invention, some background on the operation of the AK-47 rifle is warranted to make clear the operation of the embodiment described herein. The AK-47 (like the AR-15 and many other similar firearms) fires from a "closed bolt." This means that when the weapon is ready to fire, the bolt is in the closed (forward) position with a round of ammunition seated in the firing chamber. (Firing from an "open bolt," by contrast, means that the bolt is in a rearward position with no cartridge in the firing chamber when the weapon is ready to fire.) Pulling the trigger of the weapon will cause the hammer to strike the firing pin, which in turn strikes the primer in the brass cartridge case. The resulting combustion in the primer ignites the primary powder charge in the cartridge. This combustion causes a rapid increase in pressure within the firing chamber, which dislodges the bullet from the brass casing and propels the bullet forward towards the end of the barrel. Helical rifling grooves along the interior surface of the barrel cause the bullet to spin as it accelerates through the barrel, which serves to stabilize the bullet in later flight. As the bullet nears the end of the barrel, it passes a gas port at the top of the barrel that vents the high-pressure gas into a chamber at bolt carrier 1. This pressurized gas pushes bolt carrier 1 rearward, the movement of which is controlled by bolt assembly 4. The force from this rearward motion of bolt carrier 1 serves to eject the spent cartridge brass casing from the weapon and also to cock the hammer of the weapon. As the bolt carrier 1 reaches its most rearward position, its motion stops, and the compression of the spring on recoil assembly 4 then causes bolt carrier 1 to rapidly move forward again. The forward movement of bolt carrier 1 serves to pull another cartridge into the firing chamber so that the weapon is ready to fire again. In semiautomatic weapons, such as the AK-47 illustrated in FIG. 1, a disconnector prevents the weapon from firing again until the trigger is released and then pulled another time, thereby causing the hammer to drop, striking the firing pin, and repeating this process. It should be noted that weapons such as the AR-15 do not have a gas piston connected to a bolt carrier; instead, the gas in these firearms impinges directly onto the bolt to move it rearward. This "direct gas impingement" system simplifies the design of the weapon and results in a lighter weapon due to the use of fewer parts, but arguably leads to problems such as quicker fouling of the feed area from spent powder and less likelihood of a secure lock-up when the bolt returns to the forward position.

Figure 10:
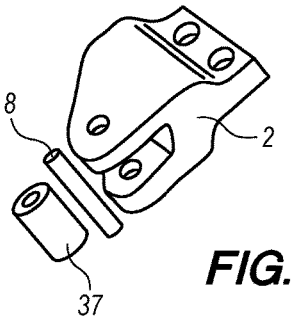
FIG. 10 is an exploded view of the drive roller and related components of an embodiment of the present invention.

Returning now to the figures, it may be seen in FIG. 1 that the illustrated embodiment utilizes a drive roller 37 that is mounted to bolt carrier 1 by means of a drive roller support 2. Drive roller 37 and its related components are shown in more detail in FIG. 10. A drive roller pin 8 is used to allow drive roller 37 to rotate freely with respect to drive roller support 2 and bolt carrier 1. It may be readily understood that as bolt carrier 1 moves to the rearward position when a cartridge is fired, driver roller 37 will be moved rearwardly as well due its mounting position on bolt carrier 1.

Driver roller 37 engages on its outer surface with the interior track of belt feed lever 5. Belt feed lever 5 is an elongated part mounted at a horizontal level adjacent to driver roller 37, and is shaped roughly as an open "V" such that its interior track extends towards the firearm on its more rearwardly portion when in the normal (rest) position. It may be understood therefore that as bolt carrier 1 moves to the rear when a cartridge is fired, drive roller 37 will engage with and roll along the interior track of belt feed lever 5. As it does so, drive roller 37 will reach the portion of belt feed lever 5 that in its normal position extends towards the weapon. The engagement with drive roller 37 will therefore cause belt feed lever 5 to deflect outwardly as bolt carrier 1 moves rearwardly.

Belt feed lever 5 is securely mounted to vertically-extending feed arm drive shaft 7, which provides a pivot point for belt feed lever 5. The deflection of belt feed lever 5 as bolt carrier 1 moves rearwardly thus causes feed arm drive shaft 7 to turn in a clockwise direction (as viewed from the top of the firearm). Lever spring 6 is attached to belt feed lever 5 in order to hold belt feed lever 5 in its normal position with its rearward portion extending toward the firearm when bolt carrier 1 is not at or near its rearward position. It may be seen then that lever spring 6 thus performs a "reset" function with respect to belt feed lever 5.

Figure 2:
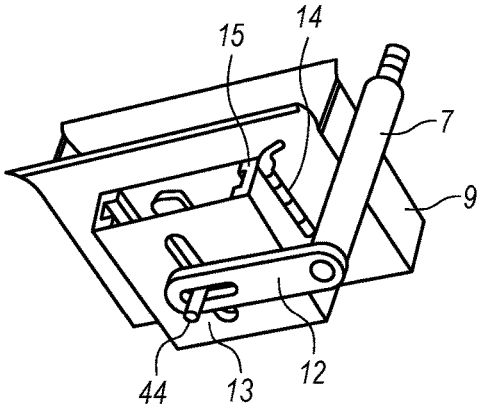
FIG. 2 is a detail perspective view of the embodiment of FIG. 1 taken in direction "A" as shown in FIG. 1.
Figure 7:
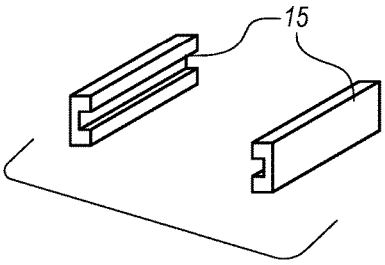
FIG. 7 is a perspective view of the hardened rails of an embodiment of the invention.

Referring now in particular to FIG. 2, which is an underside view of the feed mechanism illustrated in FIG. 1, feed arm drive shaft 7 is fed through a housing that allows it to freely turn. The housing is welded or otherwise attached as a part of main feed box (i.e., belt inlet) 9. Attached at the end of feed arm drive shaft 7 beneath main feed box 9 is lower feed pawl drive arm 12. Lower feed pawl drive arm 12 is securely attached to feed arm drive shaft 7 such that the rotation of feed arm drive shaft 7 about its longitudinal axis causes lower feed pawl drive arm 12 to deflect to the left or right with respect to the firearm, moving in a broad arc. Lower feed pawl drive arm 12 includes a longitudinal slot in its end opposite to feed arm drive shaft 7. This slot receives main pawl drive stud 44, which extends through a slot perpendicular to the slot in lower feed pawl drive arm 12 through lower feed pawl housing 13. Lower feed pawl housing 13 is attached at the bottom of main feed box 9 by box attachment pins 14. It may thus be understood that the rotation of feed arm drift shaft 7 serves to move lower feed pawl drive arm 12 in an arc, which in turn manipulates main pawl drive stud 44 in a transverse manner (i.e., left/right) with respect to the longitudinal axis of the firearm. The purpose of main pawl drive stud 44 will be described below. Lower feed pawl housing 13 includes hardened rails 15, which are shown in detail in FIG. 7. Hardened rails 15 are preferably formed of a very hard metal for purposes of durability, such as 4140 chrome steel. Like main pawl drive stud 44, the function of hardened rails 15 will be described below. Referring again to FIG. 1, upper feed box 10 is mounted above main feed box 9. Belt release lever 11 extends from upper feed box 10 and serves to provide a mechanism for releasing linked ammunition from the firearm, if desired by the user.

Figure 3:
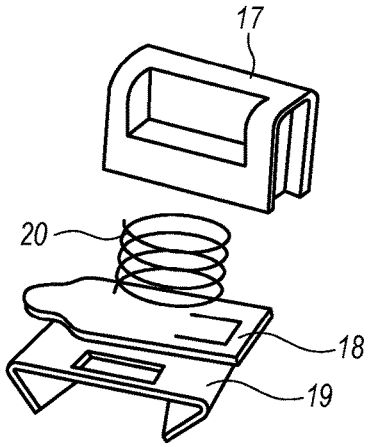
FIG. 3 is a detail exploded view of a box mount follower and related components according to an embodiment of the invention.
Figure 4:
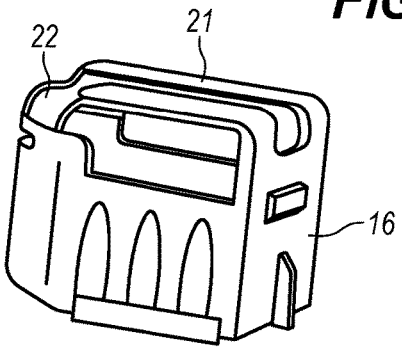
FIG. 4 is a perspective view of a box mount according to an embodiment of the invention.

Referring again to FIG. 1, magazine release 3 is used to release a magazine from the magazine well of the weapon in a conventional manner. Ammo box mount 8 serves to provide positive engagement with the magazine when inserted into the firearm. In the illustrated embodiment, the mount is of the type used for the US military standard M249 light machine gun (formerly known as the M249 squad automatic weapon or SAW). Of course other types of magazines and magazine mounts may be used in alternative embodiments. Although the illustrated embodiment is designed to receive standard ammunition magazines and to fire from a magazine as well as to use linked ammunition, when the firearm is used for firing linked ammunition (i.e., "belt fed"), removable feed tray/follower 16 is inserted in place of the standard magazine. Removable feed tray/follower 16 is shown in FIG. 4, and an exploded view of its internal components is shown in FIG. 3. Feed tray/follower 16 includes follower 17, which is biased upwardly toward the top end of feed tray/follower 16 by follower spring 20. Follower spring 20 engages on its rearward end with floor plate 18, which attaches in this embodiment to a standard M249 ammo box mount 19. It may be seen, therefore, that when feed tray/follower 16 is inserted into the firearm in place of the standard ammunition magazine, it serves to provide a feed ramp for cartridges as they are pulled into the firing chamber of the firearm when bolt carrier 1 is moving forwardly from its rearward position. This allows the cartridges to seat smoothly and reliably as they are pulled into position as the belt (i.e., the series of linked ammunition) advances from the left to the right, which will be more fully described below with reference to FIG. 6.

Figure 5:
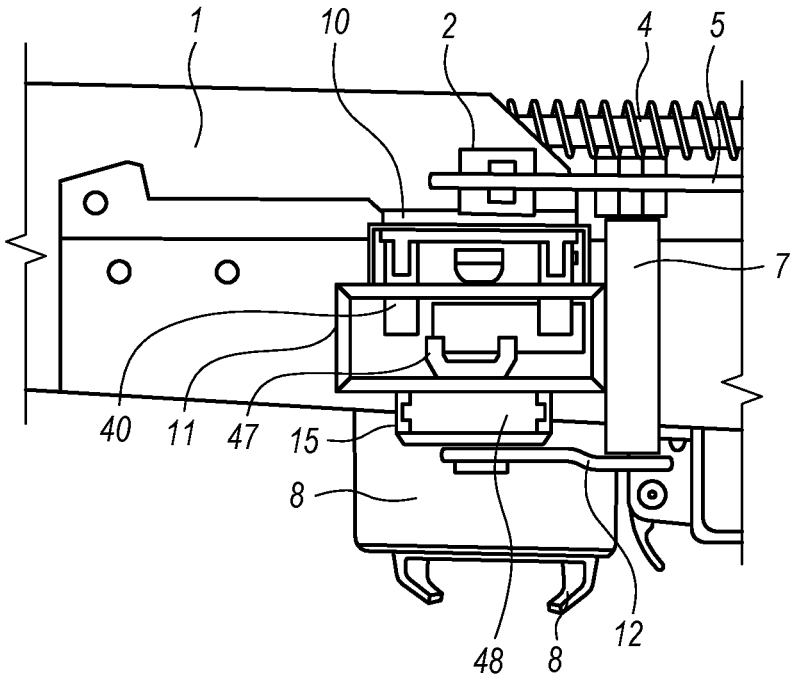
FIG. 5 is a side elevation partial cut-away view of an embodiment of the invention.
Figure 6:
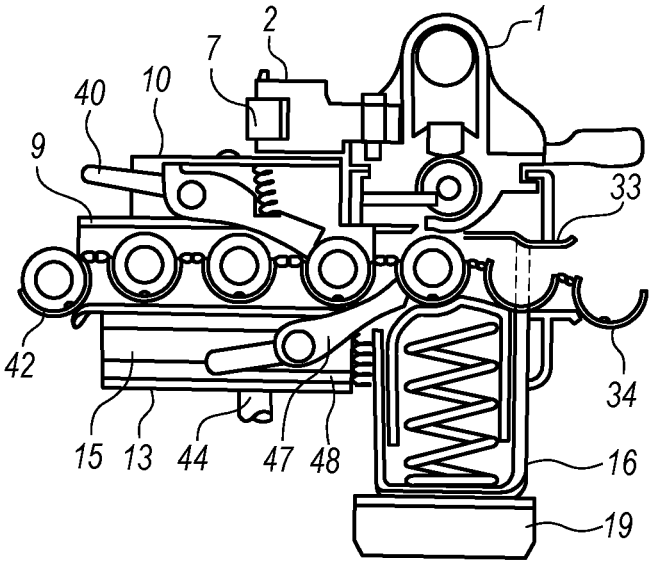
FIG. 6 is a cut-away view along the longitudinal direction of the firearm showing the internal feed mechanism for linked ammunition according to an embodiment of the invention.

Referring now to FIGS. 5 and 6, the movement of linked ammunition through the cycling of the firearm may be described in more detail. In general, the movement of cartridges is controlled by upper holding pawls 40 and lower main feed pawl 47, each of which are biased by springs to their normal position. With reference in particular to FIG. 6, it may be seen that the invention utilizes ammunition that is linked "upside down," that is, the links are positioned on the lower side of the cartridges as the ammunition is fed into the firearm, which is the opposite of the normal operation whereby links are placed on the top of the cartridges. This placement of the links allows for the operation of the embodiment as described herein. Upper holding paws 40 engage on the top side of the cartridge as it is being fed into the firearm, while lower main feed pawl 47 engages on the lower (link) side of the next cartridge in the belt as it is presented above the feed tray 21 and feed ramp 22 of removable feed tray/follower 16, while also providing back support on the lower side of the preceding cartridge to hold the linked ammunition belt securely in place during operation of the firearm. The linked ammunition enters main feed box 9 at main feed inlet 42, and the links exit on the opposite side of the firearm at ejection port 33. The now-empty links 34 fall to the right side of the firearm.

Figure 9:
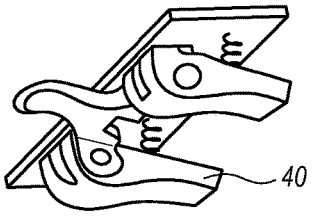
FIG. 9 is a perspective view of the upper holding pawls according to an embodiment of the invention.

FIG. 9 illustrates the arrangement of upper holding pawls 40 in more detail. They are, as noted earlier, biased by springs to the normal (downward) position, and pivotally mounted on a plate in upper feed box 10. A handle extends to the left from upper holding pawls 40, which allows for the manual disengagement of upper holding pawls 40 because the handle extends outwardly from upper feed box 10, as seen most clearly in FIG. 1.

Figure 8:
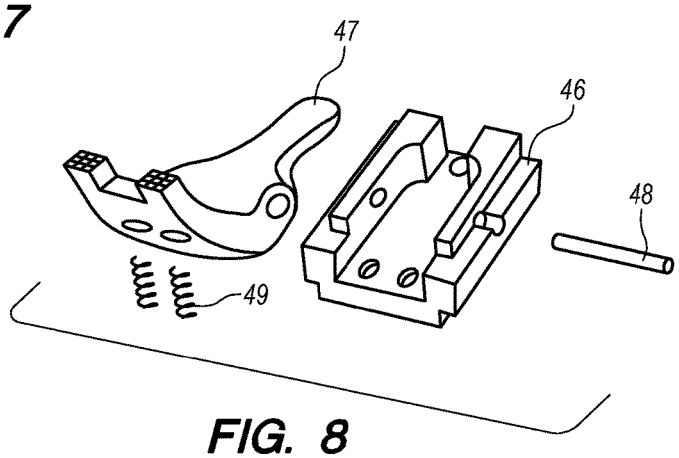
FIG. 8 is an exploded view of the main feed pawl and related components of an embodiment of the invention.

FIG. 8 illustrates the construction of lower main feed pawl 47 and its related components. Main feed pawl slide 46 receives main feed pawl 47 in a pivot mount, which rotates about lower main feed pawl pin 48. Lower main feed pawl 47 is biased to its normal (upward) position by springs 49. As earlier noted, lower main feed pawl 47 engages with main pawl drive stud 44, which serves to move lower main feed pawl 47 from its normal (upward) position to a lower position, allowing cartridges to be fed into the firearm and for the linked ammunition to advance in response to the firing of the weapon and the resultant manipulation of bolt carrier 1. It may thus be seen that hardened rails 15, which extend to the sides of the leftward end of lower main feed pawl 47, serve to provide a wear point because of the continued forceful manipulation of lower main feed pawl 47 while the weapon is in operation.

Returning now to FIGS. 5 and 6, operation of the weapon in order to advance linked cartridges may be described. As bolt carrier 1 moves rearwardly, the turning of feed arm drive shaft 7 by the engagement of drive roller 2 with belt feed lever 5 serves to move main pawl drive stud 44 through the linkage of lower feed pawl drive arm 12. This in turn forces lower main feed pawl 47 downward at its rightward end, which serves to push the belt of linked ammunition rightward, delivering an unfired cartridge to the area above removable feed tray/follower 16 and in line with the barrel and firing chamber. The force of this operation overcomes the force of the springs of upper holding pawls 40, and thereby causes upper holding pawls 40 to momentarily move upward allowing the linked ammunition belt to move, but immediately returning to the normal (downward) position to hold the belt in place once the advancement of one cartridge is complete. As bolt carrier 1 moves forwardly, the advanced cartridge is picked up along feed tray 21 and moved forwardly into the firing chamber. Once the bolt is closed, the weapon is ready to fire the next round of ammunition. Also as the advancement of the next cartridge takes place, empty links 34 exit from the right side of the firearm after the normal ejection mechanism discharges the spent brass shell casing. It will be understood that if the operator desires to release the belt of linked ammunition prior to firing the entire belt, then the handle extending from upper holding pawls 40 may be manually depressed, which depresses the spring that is biasing upper holding pawls 40 downwardly, thereby releasing the belt from the feed mechanism.

Although the embodiment described above incorporates or is used in conjunction with an AK-47 type rifle with a separate gas piston, it may be seen that in alternative embodiments the invention may be utilized with respect to direct gas impingement firearms, such as the AR-15. In this case, drive roller support 2 is not mounted to the bolt carrier 1 since there is no separate piston. Instead, drive roller support 2 is mounted in such a manner that it moves directly with the firearm's bolt, such as by mounting to the bolt handle. In another alternative, drive roller support 2 may be omitted entirely, with the bolt handle engaging directly with belt feed lever 5 to drive operation of the linked ammunition feed.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. When a Markush group or other grouping is used herein, all individual members of the group and all combinations and subcombinations possible of the group are intended to be individually included. All references cited herein are hereby incorporated by reference to the extent that there is no inconsistency with the disclosure of this specification. When a range is stated herein, the range is intended to include all sub-ranges within the range, as well as all individual points within the range. When "about," "approximately," or like terms are used herein, they are intended to include amounts, measurements, or the like that do not depart significantly from the expressly stated amount, measurement, or the like, such that the stated purpose of the apparatus or process is not lost.

The present invention has been described with reference to certain preferred and alternative embodiments that are intended to be exemplary only and not limiting to the full scope of the present invention, as set forth in the appended claims.

The invention claimed is:

1. A firearm configured to use linked ammunition wherein the linked ammunition comprises cartridges and links, the firearm comprising:

a. a V-shaped belt feed lever external to the firearm and positioned horizontally with respect to the firearm;

b. a feed arm drive shaft attached to the belt feed lever, wherein the feed arm drive shaft extends vertically downward from the belt feed lever along a side of the firearm, and further wherein the belt feed lever is linked with either a bolt carrier of the firearm or a bolt of the firearm such that rearward movement of the bolt carrier or bolt causes the belt feed lever to pivot at the feed arm drive shaft thereby rotating the feed arm drive shaft along a longitudinal axis of the feed arm drive shaft;

c. a main feed box attached to or integral with the firearm, wherein the main feed box is sized to receive linked ammunition;

d. a lower main feed pawl pivotally attached beneath the main feed box and mechanically linked to the feed arm drive shaft, wherein the lower main feed pawl is normally biased upwardly to engage a link of the linked ammunition unless acted upon by rotation of the feed arm drive shaft;

e. at least one upper holding pawl pivotally attached at a position above the main feed box and normally biased downwardly to engage a cartridge of the linked ammunition;

f. a lower feed pawl drive arm attached to the feed arm drive shaft and extending horizontally therefrom such that rotation of the feed arm drive shaft causes the lower feed pawl drive arm to swing in an arc, further wherein the lower feed pawl drive arm comprises a slot along its longitudinal axis, and further wherein the firearm comprises a main pawl drive stud extending into the slot on the lower feed pawl drive arm;

g. a lower feed pawl housing positioned below the main feed box and housing the lower main feed pawl, wherein the main pawl drive stud extends through a transverse slot in the lower feed pawl housing and is mechanically linked to the lower main feed pawl wherein rotation of the feed arm drive shaft is thereby transmitted to the lower main feed pawl to pivot downwardly the lower main feed pawl and thereby feed a new cartridge into the firearm; and h. a removable feed tray/follower adapted to fit into the firearm.

2. The firearm of claim 1, wherein the removable feed tray/follower comprises a follower, a follower spring positioned beneath the follower wherein the spring biases the follower upwardly, and a floorplate positioned beneath the spring.

3. The firearm of claim 2, further comprising an upper feed box, wherein the at least one upper holding pawl is pivotally attached within the upper feed box, and wherein the at least one upper holding pawl further comprises a handle extending outwardly from the upper feed box wherein depression of the handle is configured to release the linked ammunition from the firearm.

4. The firearm of claim 1, wherein the firearm comprises a bolt carrier, and wherein the firearm further comprises:

a. a roller support connected to the bolt carrier; and b. a roller aligned vertically to the firearm and rotatably attached to the bolt carrier, wherein the belt feed lever engages with the bolt carrier.

5. A kit for converting a firearm configured to use ammunition fed from a box magazine to use linked ammunition, wherein the linked ammunition comprises cartridges and links, the kit comprising:

a. a V-shaped belt feed lever mountable external to the firearm and positioned horizontally with respect to the firearm;

b. a feed arm drive shaft attached to the belt feed lever, wherein the feed arm drive shaft extends vertically downward from the belt feed lever along a side of the firearm, and further wherein the belt feed lever is linkable with either a bolt carrier of the firearm or a bolt of the firearm such that rearward movement of the bolt carrier or bolt causes the belt feed lever to pivot at the feed arm drive shaft thereby rotating the feed arm drive shaft along a longitudinal axis of the feed arm drive shaft;

c. a main feed box attachable to the firearm, wherein the main feed box is sized to receive linked ammunition;

d. a lower main feed pawl pivotally attached beneath the main feed box and mechanically linked to the feed arm drive shaft, wherein the lower main feed pawl is normally biased upwardly to engage a link of the linked ammunition unless acted upon by rotation of the feed arm drive shaft;

e. at least one upper holding pawl pivotally attached at a position above the main feed box and normally biased downwardly to engage a cartridge of the linked ammunition;

f. a lower feed pawl drive arm attached to the feed arm drive shaft and extending horizontally therefrom such that rotation of the feed arm drive shaft causes the lower feed pawl drive arm to swing in an arc, further wherein the lower feed pawl drive arm comprises a slot along its longitudinal axis at the feed arm drive shaft, and further wherein the kit comprises a main pawl drive stud extending into the slot on the lower feed pawl drive arm;

g. a lower feed positioned below the main feed box wherein the lower feed houses the lower main feed pawl, and wherein the main pawl drive stud extends through a transverse slot in a lower side of the lower feed and is mechanically linked to the lower main feed pawl wherein rotation of the feed arm drive shaft is thereby transmitted to the lower main feed pawl to pivot downwardly the lower main feed pawl and thereby feed a new cartridge into the firearm; and h. a removable feed tray/follower adapted to fit into the firearm.

6. The kit of claim 5, wherein the removable feed tray/follower comprises a follower, a follower spring positioned beneath the follower wherein the spring biases the follower upwardly, and a floorplate positioned beneath the spring.

7. The kit of claim 6, further comprising an upper feed box, wherein the at least one upper holding pawl is pivotally attached within the upper feed box, and wherein the at least one upper holding pawl further comprises a handle extending outwardly from the upper feed box wherein depression of the handle is configured to release the linked ammunition from the firearm.

8. The kit of claim 5, wherein the firearm comprises a bolt carrier, and wherein the kit further comprises:

a. a roller support connectable to the bolt carrier;

b. a roller aligned vertically to the firearm and rotatably attached to the bolt carrier, wherein the belt feed lever engages with the bolt carrier.

* * * * *